US010716364B2

(12) United States Patent
Garcia et al.

(10) Patent No.: US 10,716,364 B2
(45) Date of Patent: Jul. 21, 2020

(54) SHOE INSERTS

(71) Applicant: MATTHEWS INTERNATIONAL CORPORATION, Pittsburgh, PA (US)

(72) Inventors: Chelsea Garcia, Lansing, MI (US); Ryan Davis, Chicago, IL (US)

(73) Assignee: Matthews International Corporation, Pittsburgh, PA (US)

( * ) Notice: Subject to any disclaimer, the term of this patent is extended or adjusted under 35 U.S.C. 154(b) by 0 days.

(21) Appl. No.: 15/870,431

(22) Filed: Jan. 12, 2018

(65) Prior Publication Data

US 2018/0192742 A1 Jul. 12, 2018

Related U.S. Application Data

(60) Provisional application No. 62/445,365, filed on Jan. 12, 2017.

(51) Int. Cl.
*A43D 3/14* (2006.01)
*A43B 1/00* (2006.01)

(52) U.S. Cl.
CPC ..... *A43D 3/1433* (2013.01); *A43B 1/0045* (2013.01); *A43D 3/1416* (2013.01); *A43D 3/1491* (2013.01)

(58) Field of Classification Search
CPC ... A43D 3/1416; A43D 3/1433; A43D 3/1491
USPC ..... 12/114.2, 128 R, 128 B, 133 A
See application file for complete search history.

(56) References Cited

U.S. PATENT DOCUMENTS

| | | | | |
|---|---|---|---|---|
| 122,969 | A | 1/1872 | Sage | |
| 461,492 | A | 10/1891 | Browning | |
| 896,536 | A * | 8/1908 | Hayden | A43D 3/1491 12/114.2 |
| 1,222,470 | A | 4/1917 | Ross | |
| 1,853,896 | A * | 4/1932 | Enrich | A43D 3/1441 12/114.2 |
| 2,670,482 | A * | 3/1954 | Roman | A43D 3/1441 12/128 R |
| 3,086,520 | A | 4/1963 | Scholl | |
| 3,487,830 | A | 1/1970 | Pruett | |
| D282,022 | S | 1/1986 | Wright | |
| 4,991,318 | A | 2/1991 | Cornell | |
| D345,449 | S | 3/1994 | Armstrong | |
| 5,291,669 | A * | 3/1994 | Khoury | A43D 3/1433 12/128 B |
| 5,487,198 | A | 1/1996 | Mueller et al. | |
| 5,809,666 | A | 9/1998 | Harwood | |
| D420,784 | S | 2/2000 | Riecken | |
| D429,878 | S | 8/2000 | Tsung-Ping | |

(Continued)

OTHER PUBLICATIONS

International Search Report and Written Opinion for PCT/US2018/013617 dated Mar. 8, 2018.

*Primary Examiner* — Marie D Bays
(74) *Attorney, Agent, or Firm* — Pepper Hamilton LLP

(57) ABSTRACT

The present disclosure relates to a device for retaining the shape of a shoe. The shoe insert provided herein for retaining the shape of a shoe includes a toe fabric bag and a vamp fabric bag. Each fabric bag may be made of a malleable form-fitting fabric. Each fabric bag may be of different sizes and shapes to fit shoes of different sizes and shapes. Also disclosed are methods of manufacturing a shoe insert and methods of using a device for retaining the shape of a shoe.

30 Claims, 8 Drawing Sheets

(56) References Cited

U.S. PATENT DOCUMENTS

| | | | | |
|---|---|---|---|---|
| 6,810,603 | B1 | 11/2004 | Cosentino | |
| D616,182 | S | 5/2010 | Nelson | |
| 7,856,741 | B2 | 12/2010 | Nguyen et al. | |
| 7,856,742 | B2 | 12/2010 | Nguyen et al. | |
| D646,472 | S | 10/2011 | Chen | |
| D646,473 | S | 10/2011 | Wong | |
| D659,365 | S | 5/2012 | Huebner | |
| D663,931 | S | 7/2012 | Allen et al. | |
| 8,578,634 | B1 | 11/2013 | Nguyen et al. | |
| D812,358 | S | 3/2018 | Garcia et al. | |
| 2003/0177593 | A1* | 9/2003 | Chang | A43D 3/145 12/114.2 |
| 2005/0241081 | A1* | 11/2005 | Nadler | A43D 3/04 12/114.4 |
| 2009/0031507 | A1* | 2/2009 | McChesney | A43D 3/1433 12/115.6 |

* cited by examiner

SHOE INSERTS

CLAIM OF PRIORITY

This application claims the benefit of priority to U.S. Provisional Application No. 62/445,365, titled "Shoe Inserts," filed Jan. 12, 2017, which is incorporated herein by reference in its entirety.

BACKGROUND

Shoetrees and shoe inserts have been used to maintain the shape of footwear for many years. When shoes sit idle without a firm foot substitute in place, they will naturally begin to fall out of shape and often become ruffled and wrinkled. Generally, a shoe insert solves this problem by occupying portions of a shoe to support the structure of the shoe. As such, a shoe insert is important for the long term care of a shoe, as it serves to impede the development of creases in the fabric of the shoe and helps to maintain the shoe's overall shape.

A shortfall of current shoe inserts is that they are incapable of supporting a variety of shoe shapes and sizes. For example, recycled formed paperboard and plastic inserts are rigid and offer no compression that would allow them to form to the individual shapes of different shoes. Pre-formed shoe inserts are custom molded and thus generally only fit the style of shoe with which they were packaged. Wood and spacer bar shoe inserts are capable of achieving varying lengths, however the toe member that engages the front portion of a shoe is fixed and cannot be compressed to accommodate different toe boxes. Additionally, wood and spacer bar shoe inserts are expensive and require mechanical embodiments that are not easily engaged in the shoe. Generally such inserts only accommodate loafer-style shoes and cannot be used with heels, flats, boots or sandals.

A further need exists to maintain the structure and aesthetics for a wide-variety of shoe types during photography. Taking photographs of shoes without a human foot to provide the form requires much manipulation of the shoe by the photographer. As such, the need exists for a shoe insert which will provide a natural appearance to the shoe. Current materials used when photographing footwear, including batting, paper, tissue, or the like, are difficult to properly position and may release dust or fibers that can attach to the outside of the shoe and are difficult to remove. In addition, cotton batting and tissue paper can each add additional bumps or textures to the silhouette of the shoe that can be difficult to manipulate once the shoe is styled. In some cases, smoothing the exterior of the shoe can require the shoe to be completely restyled.

Embodiments of the disclosure described herein for a new and improved shoe insert overcome one or more of these disadvantages.

SUMMARY

The present disclosure generally relates to a device for retaining the shape of a shoe. In some embodiments, a shoe insert comprises a toe fabric bag adapted to fit into a front portion of the shoe, and a vamp fabric bag adapted to fit into a vamp portion of the shoe. The fabric bags may be of different sizes and/or shapes to fit shoes of different sizes and shapes.

Embodiments herein also describe a method of manufacturing a shoe insert, comprising forming a toe fabric bag comprising a flexible material having a compressible form-fitting material dispersed within; and forming a vamp fabric bag comprising a flexible material having a compressible form-fitting material dispersed within. In some embodiments, the flexible material may be fabric or canvas.

Some embodiments describe a method of retaining the shape of a shoe comprising placing a toe fabric bag into a front portion of a shoe and a vamp fabric bag into a vamp portion of a shoe.

Some embodiments describe a method of retaining the shape of a shoe comprising placing a toe fabric bag into a front portion of a shoe.

Some embodiments describe a shoe insert kit comprising a toe fabric bag configured for insertion into a front portion of a shoe and a vamp fabric bag configured for insertion into a vamp portion of a shoe.

BRIEF DESCRIPTION OF THE DRAWINGS

For a fuller understanding of the nature and advantages of the present disclosure, reference should be made to the following detailed description taken in connection with the accompanying drawings, in which.

DETAILED DESCRIPTION

Before the present devices and methods are described, it is to be understood that this disclosure is not limited to the particular processes, devices, or methodologies described, as these may vary. It is also to be understood that the terminology used in the description is for the purpose of describing the particular versions or embodiments only, and is not intended to limit the scope of the present disclosure which will be limited only by the appended claims. Unless defined otherwise, all technical and scientific terms used herein have the same meanings as commonly understood by one of ordinary skill in the art. Although any methods and materials similar or equivalent to those described herein can be used in the practice or testing of embodiments of the present disclosure, the preferred methods, devices, and materials are now described. All publications mentioned herein are incorporated by reference in their entirety. Nothing herein is to be construed as an admission that the disclosure is not entitled to antedate such disclosure by virtue of prior disclosure.

It must also be noted that as used herein and in the appended claims, the singular forms "a", "an", and "the" include plural reference unless the context clearly dictates otherwise. Thus, for example, reference to a "fabric" is a reference to one or more fabrics and equivalents thereof known to those skilled in the art, and so forth.

As used herein, the term "about" means plus or minus 10% of the numerical value of the number with which it is being used. Therefore, about 12 inches means in the range of 10.8 inches to 13.2 inches.

The present disclosure is directed towards a shoe insert, and the word "shoe" is understood to refer to all footwear, including, but not limited to, dress shoes, casual shoes, pumps, flats, high heels, sneaker boots, sandals, wedge sandals, platform shoes, loafers, boat shoes, boots, slippers, sneakers, golf shoes, ballet shoes, cleats, and ballroom shoes.

Figure 1:
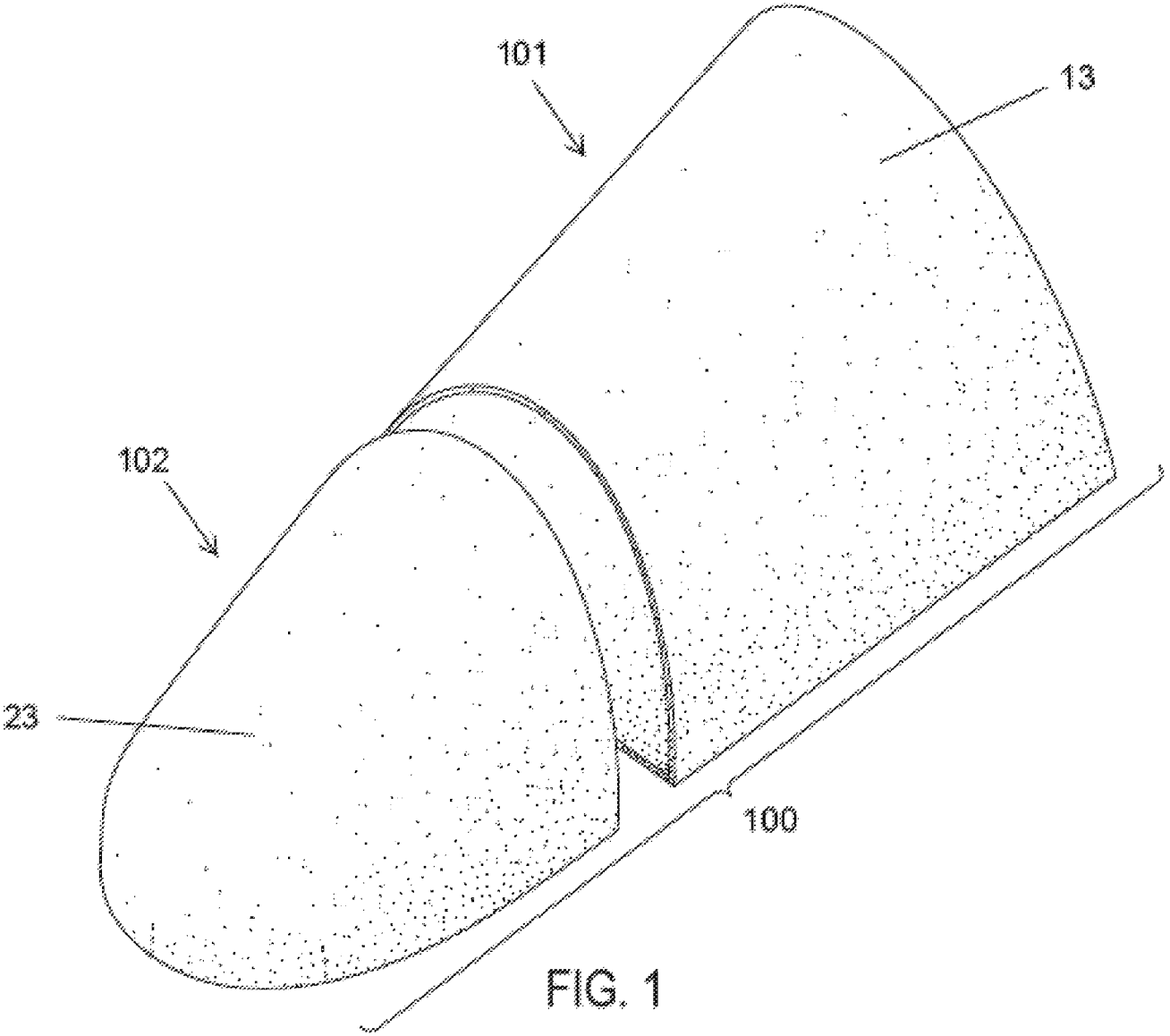
FIG. 1 is a side perspective view of a shoe insert, with a toe fabric bag towards the bottom and a vamp fabric bag towards the top.

Referring now in detail to the figures, wherein like reference numerals represent like parts throughout the several views, one exemplary embodiment is shown in FIG. 1, which illustrates a shoe insert 100. The shoe insert 100 is made of two separate fabric bag constructions, a vamp fabric bag 101 a separate toe fabric bag 102. Each fabric bag comprises a compressible, malleable, moldable, form-fitting material dispersed within, which allows the shoe insert 100 to occupy a toe portion and/or a vamp portion of a range of shoe shapes and sizes by forming to the contours of such shoes. As used herein, the "vamp" means any portion of the shoe or boot after the front portion, including, without limitation, the middle portion or heel portion of the shoe or boot, or a combination thereof. The vamp fabric bag may be added to act as a counterweight to the toe fabric bag and may be placed within the vamp portion of the shoe. In some embodiments, for example, where insertion of the vamp fabric bag 101 is not required to maintain/retain the shape of the shoe, such as for certain high heels, the toe fabric bag 102 may be used alone. The outer surface 23 of the toe fabric bag 102 and the outer surface 13 of the vamp fabric bag 101 may comprise a fabric that is wrinkle-free, durable and malleable. Placement of the toe fabric bag 102 in the toe portion of the shoe, and the vamp fabric bag 101, inserted separately, in the vamp portion of the shoe, exerts pressure on the walls of the shoe to maintain the natural shape or fullness of the shoe. In certain embodiments, the total length of the shoe insert 100, including both the length of the toe fabric bag 102 and the vamp fabric bag 101 is about 1.5 inches, about 2 inches, about 2.5 inches, about 3 inches, about 3.5 inches, about 4 inches, about 4.5 inches, about 5 inches, about 5.5 inches, about 6 inches, about 6.5 inches, about 7 inches, about 7.5 inches, about 8 inches, about 8.5 inches, about 9 inches, about 9.5 inches, about 10 inches, about 10.5 inches, about 11 inches, about 11.5 inches, about 12 inches, about 12.5 inches, about 13 inches, or is within a range between any two of the values.

Figure 2:
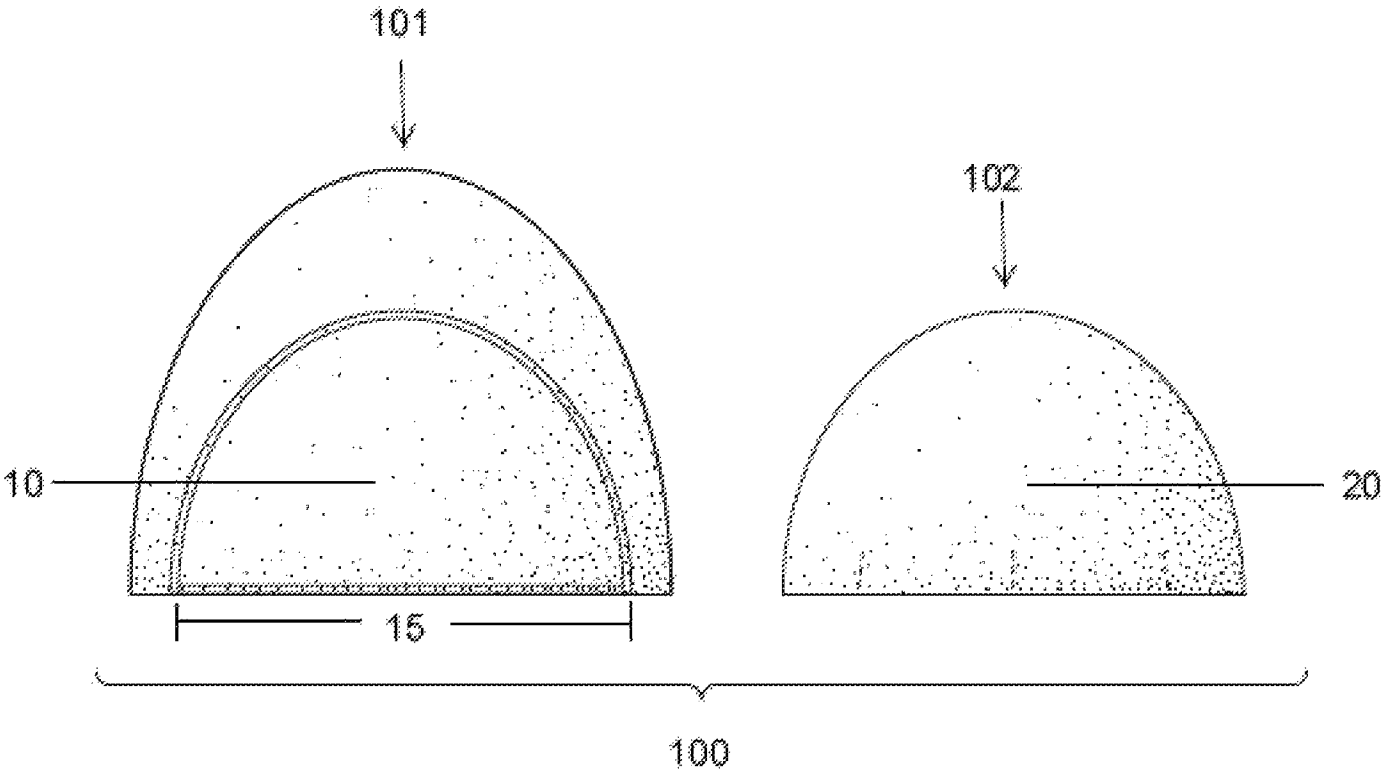
FIG. 2 is a front elevation view of the toe fabric bag on the right and vamp fabric bag on the left.

FIG. 2 provides a front elevation view of shoe insert 100, wherein the vamp fabric bag 101 has a flat, curved shaped front surface 10 and the toe fabric bag 102 has a curved front surface 20. The vamp fabric bag 101 has a front width 15. In some embodiments, the front width 15 is about 1.5 inches, about 2 inches, about 2.5 inches, about 3 inches, about 3.5 inches, about 4 inches, about 4.5 inches, about 5 inches, about 5.5 inches, about 6 inches, or is within a range between any two of the values.

Figure 3:
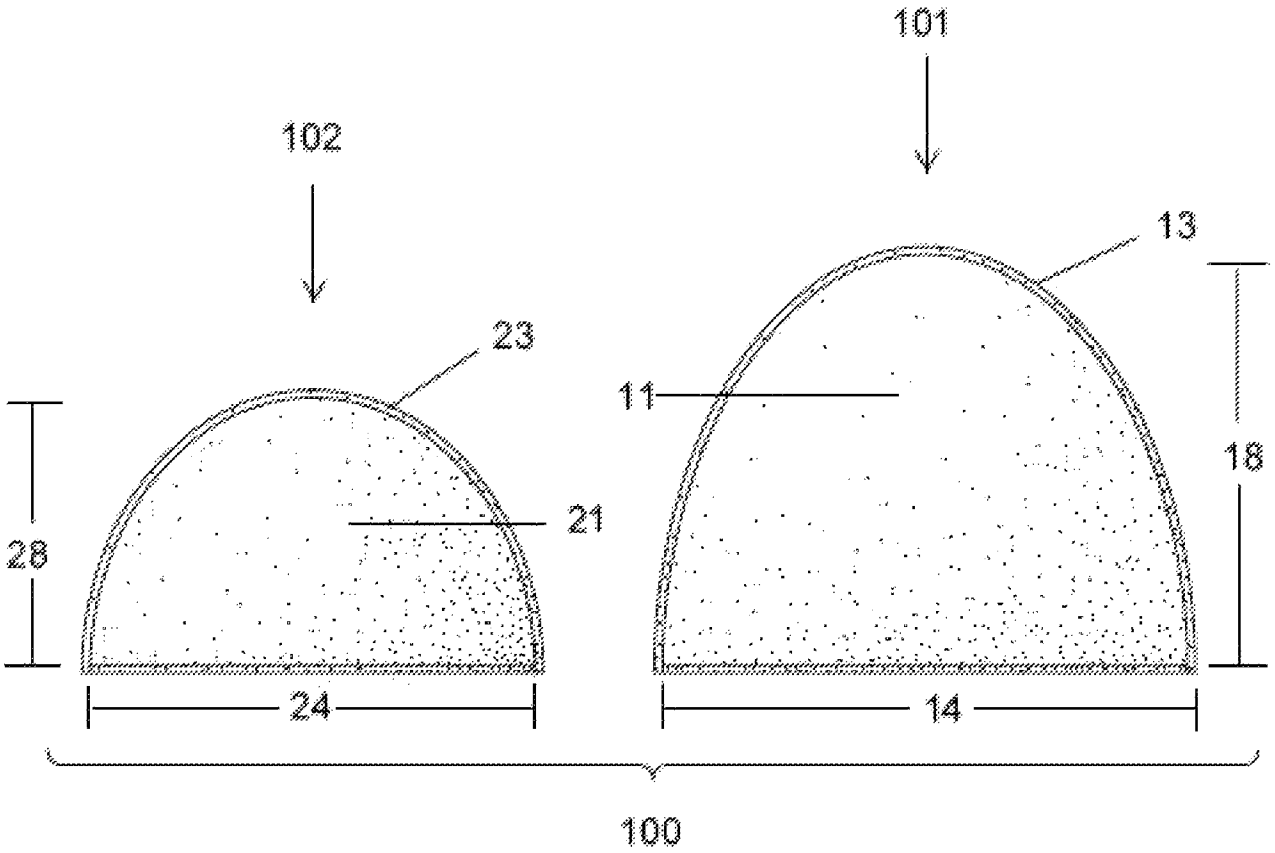
FIG. 3 is a rear elevation view of the toe fabric bag on the left and vamp fabric bag on the right.

FIG. 3 provides a rear elevation view of the shoe insert 100. As shown in FIG. 3, the vamp fabric bag 101 has a flat, curved shaped back surface 11, and the toe fabric bag 102 has a flat, curved shaped back surface 21. The vamp fabric bag 101 has a height 18. In some embodiments, the height 18 is about 1 inch, about 1.5 inches, about 2 inches, about 2.5 inches, about 3 inches, about 3.5 inches, about 4 inches, about 4.5 inches, about 5 inches, about 5.5 inches, about 6 inches, about 6.5 inches, about 7 inches, about 7.5 inches, about 8 inches, about 8.5 inches, about 9 inches, about 9.5 inches, about 10 inches, or is within a range between any two of the values. The toe fabric bag 102 has a height 28. In some embodiments, the height 28 is about 0.5 inch, about 1 inch, about 1.5 inches, about 2 inches, about 2.5 inches, about 3 inches, about 3.5 inches, about 4 inches, about 4.5 inches, about 5 inches, about 5.5 inches, about 6 inches, about 6.5 inches, about 7 inches, about 7.5 inches, about 8 inches, or is within a range between any two of the values. Further, the vamp fabric bag 101 has a back width 14. In some embodiments, the back width 14 is about 2 inches, about 2.5 inches, about 3 inches, about 3.5 inches, about 4 inches, about 4.5 inches, about 5 inches, about 5.5 inches, about 6 inches, about 6.5 inches, about 7 inches, about 7.5 inches, about 8 inches, about 8.5 inches, about 9 inches, about 9.5 inches, about 10 inches, or is within a range between any two of the values. The toe fabric bag 102 has a width 24. In some embodiments, the back width 24 is about 1.5 inches, about 2 inches, about 2.5 inches, about 3 inches, about 3.5 inches, about 4 inches, about 4.5 inches, about 5 inches, about 5.5 inches, about 6 inches, or is within a range between any two of the values.

In some embodiments, the surface area of the front surface 10 of the vamp fabric bag 101 is smaller than the surface area of the back surface 11 of the vamp fabric bag 101.

Figure 4:
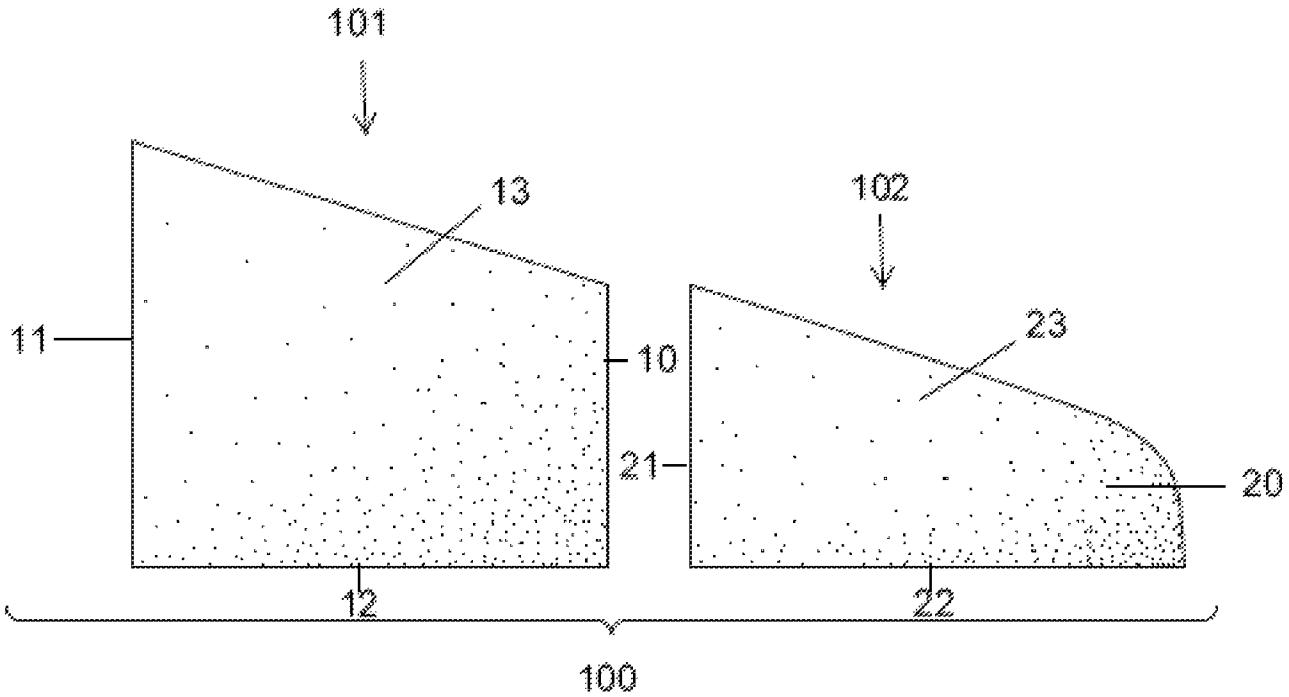
FIG. 4 is a right side elevation view of the shoe insert, with the toe fabric bag on the right and the vamp fabric bag on the left.
Figure 5:
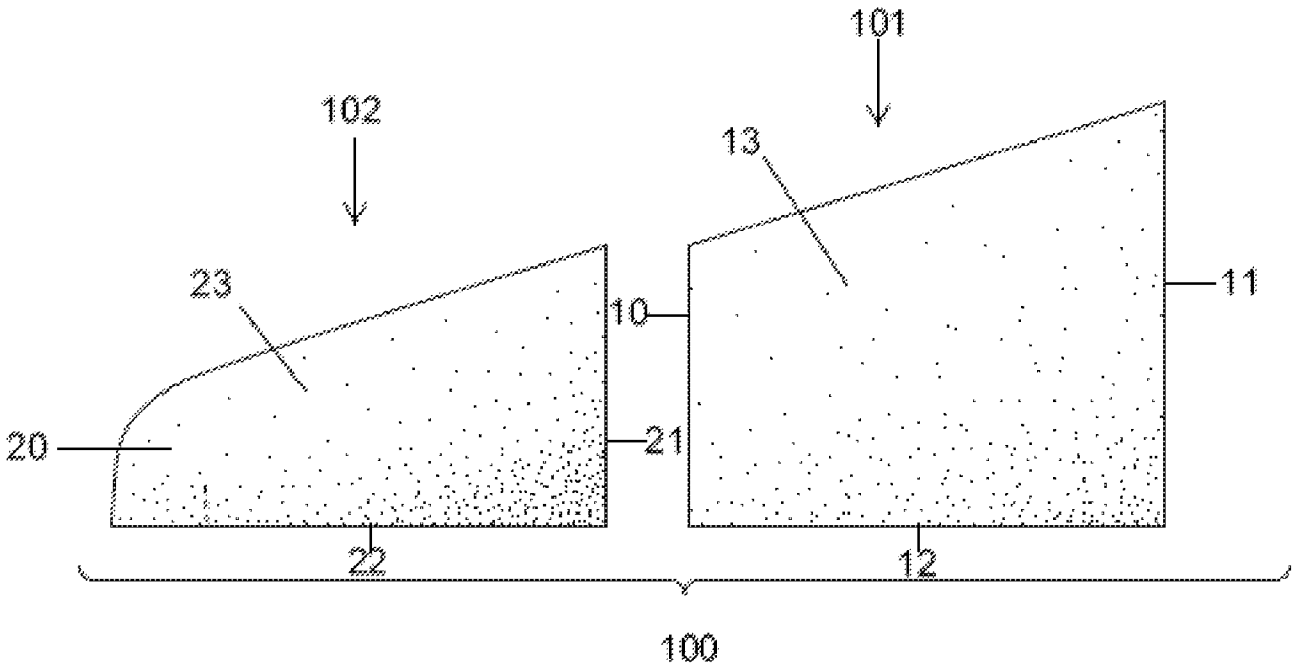
FIG. 5 is a left side elevation view of the shoe insert, with the toe fabric bag on the left and the vamp fabric bag on the right.
Figure 6:
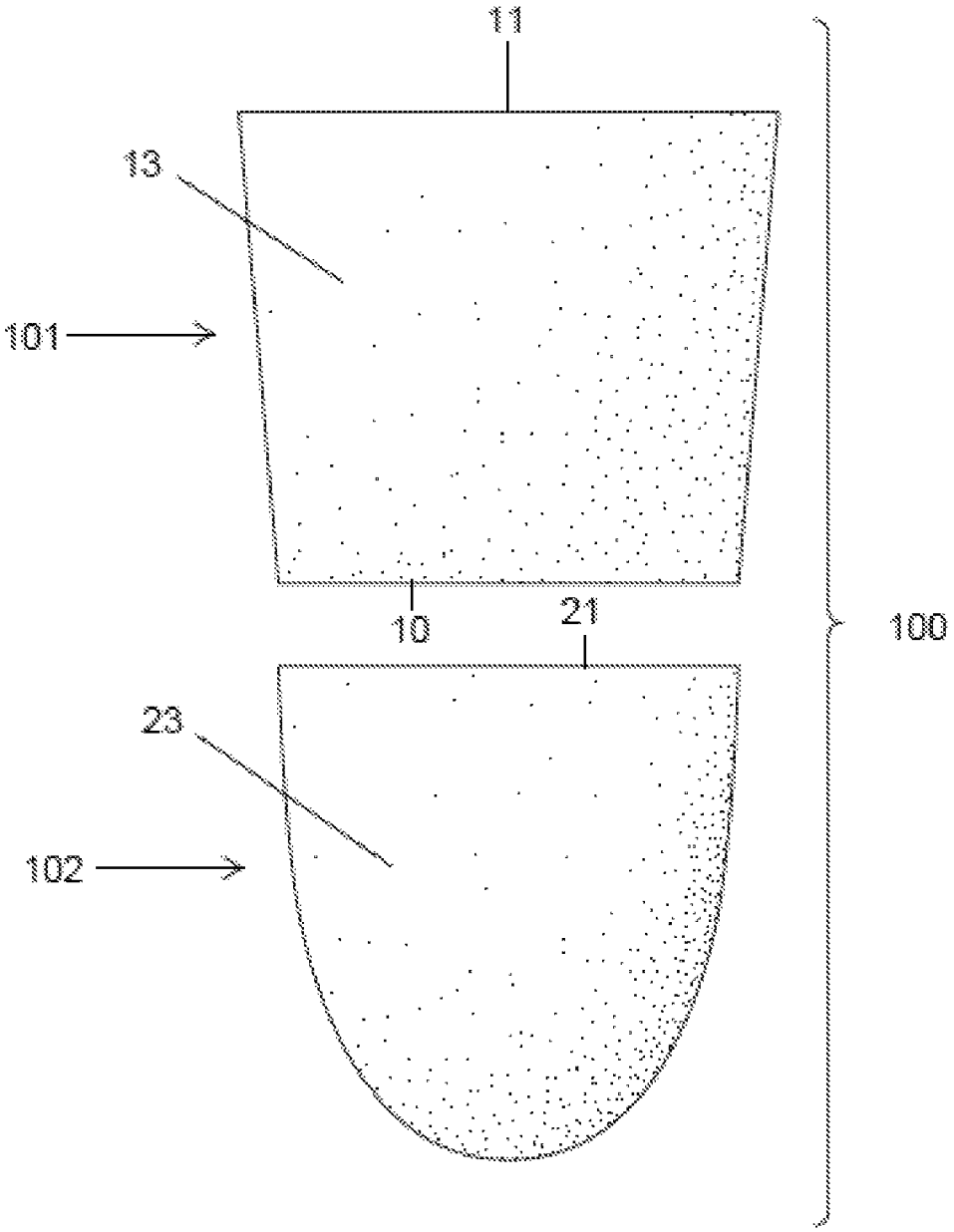
FIG. 6 is a top elevation view of the shoe insert, with the toe fabric bag at the bottom and the vamp fabric bag at the top.

FIG. 4 is a right side elevation view and FIG. 5 is a left side elevation view of the shoe insert 100. The vamp fabric bag 101 has a curved surface 13 and a flat, bottom surface 12. The toe fabric bag 102 has a curved surface 23, which is continuous with the curved front surface 20, and a flat, bottom surface 22. As shown in FIG. 6, the cross-sectional area of the curved surface 23 of the toe fabric bag 102 gradually decreases towards the curved front surface 20. In some embodiments, the surface area of the flat, curved shaped back surface 21 of the toe fabric bag 102 is equal to the surface area of the flat, curved shaped front surface 10 of the vamp fabric bag 101.

Figure 7:
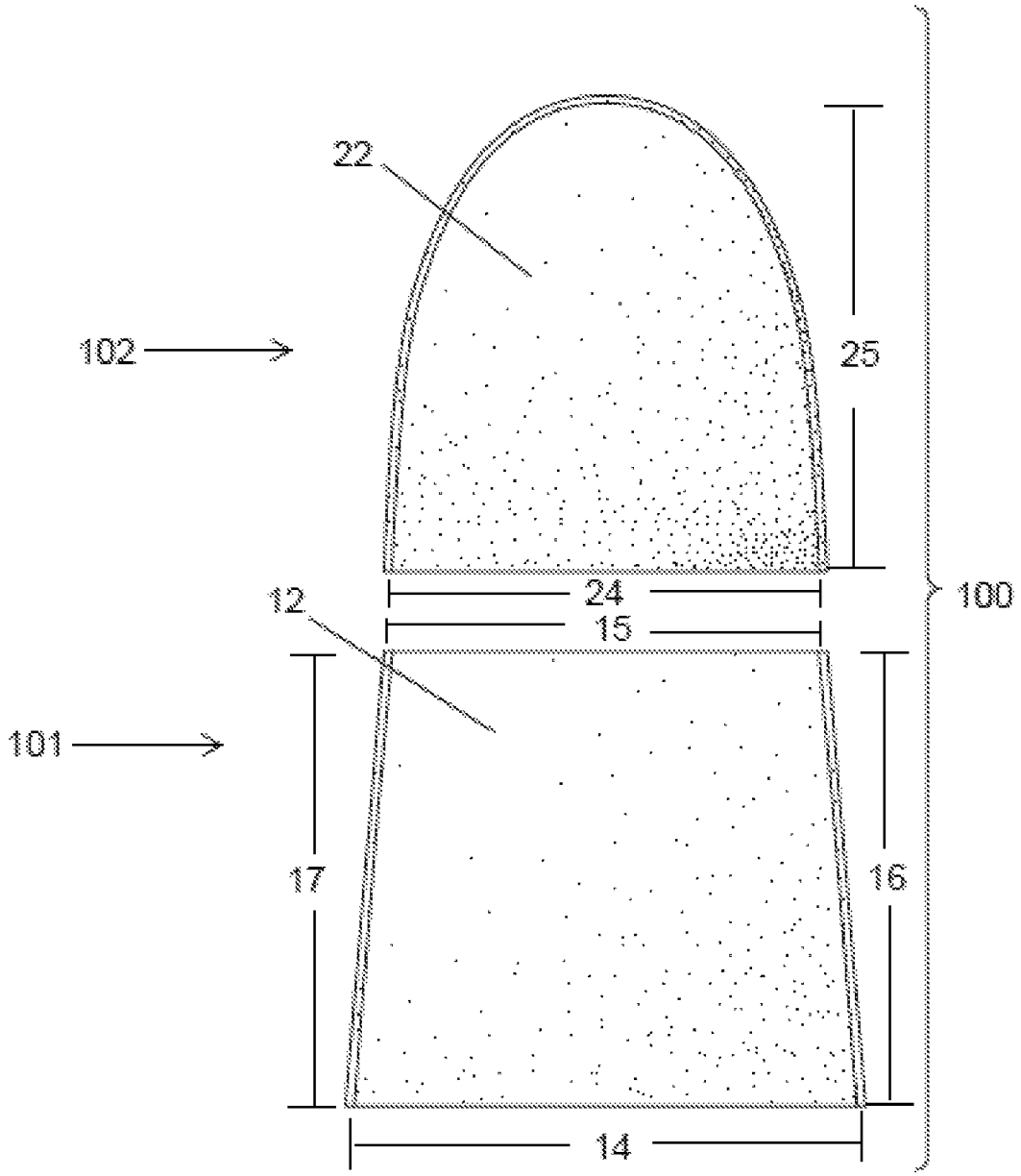
FIG. 7 is a bottom elevation view of the shoe insert, with the toe fabric bag at the top and the vamp fabric bag at the bottom.

FIG. 7 is a bottom elevation view of the shoe insert 100. As shown in FIG. 7 the bottom surface 12 of the vamp fabric bag 101 may be a trapezoid comprised of 2 parallel sides, back width 14 and front width 15, wherein the front width 15 is shorter than the back width 14, and lengths 16 and 17 are equal. In some embodiments, lengths 16 and 17 are about 1 inch, about 1.5 inches, about 2 inches, about 2.5 inches, about 3 inches, about 3.5 inches, about 4 inches, about 4.5 inches, about 5 inches, about 5.5 inches, about 6 inches, 6.5 inches, about 7 inches, or is within a range between any two of the values. FIG. 7 also shows the shape of the bottom surface 22 of the toe fabric bag 102. The toe fabric bag 102 has a length 25. In some embodiments, the length 25 is 0.5 inch, about 1 inch, about 1.5 inches, about 2 inches, about 2.5 inches, about 3 inches, about 3.5 inches, about 4 inches, about 4.5 inches, about 5 inches, about 5.5 inches, about 6 inches, or is within a range between any two of the values.

Figure 8:
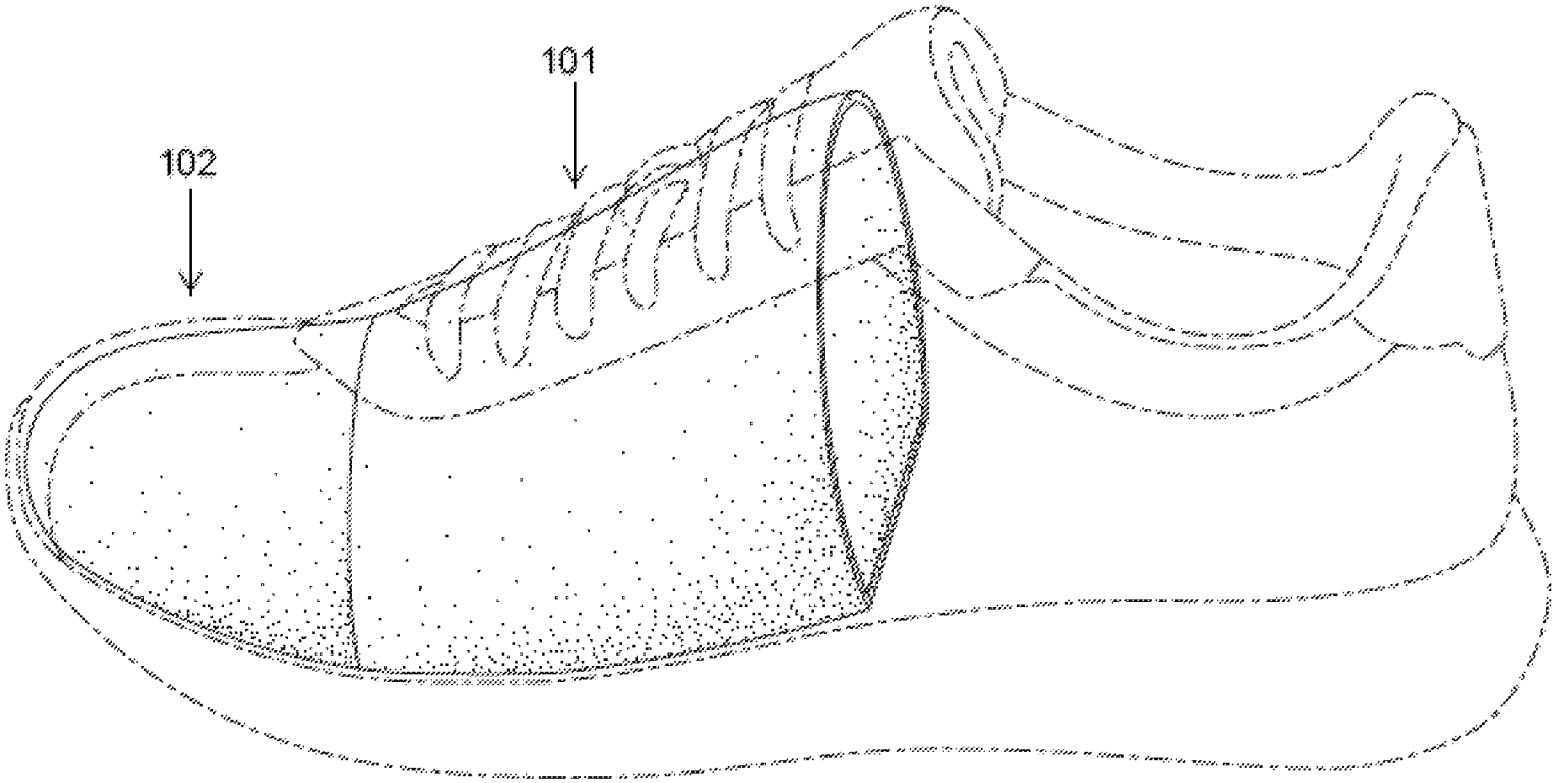
FIG. 8 is a perspective view of the shoe insert as used within a shoe.

FIG. 8 provides a perspective view of the shoe insert 100 inside a shoe comprising the toe fabric bag 102 at the front of the shoe and the vamp fabric bag 101 beneath the tongue and laces of the shoe.

In some embodiments described herein, the toe fabric bag 102 and the vamp fabric bag 101 are constructed as modular fabric bags. The fabric bags may be tailored in a manner that provides the shoe with an appearance that is natural and completely fills the shoe. In some embodiments described herein, the fabric bags are constructed of a flexible material.

In some embodiments, the flexible material is durable, sufficiently fine to not add additional texture to the shoe, and/or sufficiently malleable to manipulate within a variety of shoe types. In some embodiments, the flexible material is fabric. The fabric may be selected from canvas, fleece, silk, cotton, cashmere, linen, rayon, satin, burlap, any other fabric, or a combination thereof. In some embodiments, the fabric may be selected to minimize the formation of wrinkles.

In some embodiments, the fabric bag further comprises a lining. In some embodiments, the lining may be selected from canvas, fleece, silk, cotton, cashmere, linen, rayon, satin, burlap, any other fabric, or a combination thereof.

In some embodiments described herein, the fabric bags are fabricated with minimal seams to ensure a smooth surface within the shoe. In some embodiments described herein, the seams formed are secured by stitching, glue, tape, liquid stitch, clips, pins, hook and loop closures, staples, or a combination thereof.

In some embodiments described herein, the toe and vamp fabric bags are each filled with a compressible form-fitting material. In some embodiments, the compressible form-fitting material is sufficiently fine to not add additional texture to the shoe and/or sufficiently malleable to manipulate within a variety of shoe types. In some embodiments described herein, the compressible form-fitting material is selected from sand, silica, foam beads, shredded foam, polystyrene particles, popped styrene beads, plastic pellets, cedar chips, polyurethane, polyurethane foam, cotton, ethylene vinyl acetate (EVA), thermo-moldable foam, memory foam, rubber, polyvinyl chloride (PVC) foam, polyethylene (EPE) foam, latex foam, silicon gel, or a combination thereof.

In some embodiments, the toe fabric bag 102 and/or the vamp fabric bag 101 comprise one or more seams secured by stitching, gluing, taping, liquid stitching, clipping, pinning, using a hook and loop closure, stapling, or a combination thereof. Other forms of attaching fabric to fabric known to those skilled in the art are considered to be within the scope of this disclosure.

In some embodiments, the toe fabric bag 102 and the vamp fabric bag 101 of the shoe insert may contain a fragrance or an antibacterial component.

In some embodiments, the shoe insert comprises both a toe fabric bag and a vamp fabric bag, only a toe fabric bag, or only a vamp fabric bag.

Some embodiments herein are directed to a method of manufacturing a shoe insert comprising forming a toe fabric bag comprising a flexible material and having a compressible form-fitting material dispersed within; and forming a vamp fabric bag comprising a flexible material and having a compressible form-fitting material dispersed within. In some embodiments, the flexible material may be fabric. In some embodiments, the fabric may be selected from canvas, fleece, silk, cotton, cashmere, linen, rayon, satin, burlap, any other fabric, or a combination thereof. In some embodiments described herein, the compressible form-fitting material is selected from sand, silica, foam beads, shredded foam, polystyrene particles, popped styrene beads, plastic pellets, cedar chips, polyurethane, polyurethane foam, ethylene vinyl acetate (EVA), thermo thermo-moldable foam, memory foam, rubber, PVC polyvinyl chloride (PVC) foam (polyvinyl chloride), polyethylene (EPE) foam (polyethylene), latex foam, silicon gel, or a combination thereof.

In some embodiments, forming the toe fabric bag comprises securing one or more seams of the toe fabric bag. In some embodiments, forming the vamp fabric bag comprises securing one or more seams of the vamp fabric bag. In some embodiments, securing one or more seams comprises stitching, gluing, taping, liquid stitching, clipping, pinning, using a hook and loop closure, stapling, or a combination thereof. Other forms of attaching fabric to fabric known to those skilled in the art are also considered to be within the scope of this disclosure.

Embodiments described herein include a method of retaining the shape of a shoe, comprising: providing a toe fabric bag and a vamp fabric bag, and placing the toe fabric bag into a front portion of a shoe and the vamp fabric bag into a vamp portion of a shoe. In some embodiments, the method of retaining the shape of a shoe comprises providing a toe fabric bag and placing the toe fabric bag into the front portion of the shoe. In some embodiments, the method of retaining the shape of a shoe comprises providing a vamp fabric bag and placing the vamp fabric bag into the vamp portion of the shoe.

Some embodiments describe a method of retaining the shape of a shoe comprising placing a toe fabric bag of embodiments herein into a front portion of a shoe and a vamp fabric bag of embodiments herein into a vamp portion of a shoe. Some embodiments describe a method of retaining the shape of a shoe comprising placing a toe fabric bag of embodiments herein into a front portion of a shoe. Some embodiments describe a method of retaining the shape of a shoe comprising placing a vamp fabric bag of embodiments herein into a vamp portion of a shoe. In some embodiments, the method of retaining is for use with photography, display, transportation, styling, storage, or a combination thereof.

Some embodiments describe a shoe insert kit comprising a toe fabric bag of embodiments herein configured for insertion into a front portion of a shoe and a vamp fabric bag configured for insertion into a vamp portion of a shoe.

In the above detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented herein. It will be readily understood that various features of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various features. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups. It will be further understood by those within the art that if a specific number of an introduced claim recitation is intended, such an intent will be explicitly recited in the claim, and in the absence of such recitation no such intent is present.

For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (for example, "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (for example, the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art all language such as "up to," "at least," and the like include the number recited and refer to ranges that can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A device for retaining the shape of a shoe comprising:

a toe fabric bag adapted to fit into a front portion of the shoe for retaining a shape of the shoe; and a vamp fabric bag adapted to fit into a vamp portion of the shoe for retaining a moldable shape of the shoe;

wherein a width of a rear portion of the toe fabric bag is the same as a width of a front portion of the vamp fabric bag.

2. The device of claim 1, wherein the toe fabric bag has a length of about 0.5 inches to about 6 inches.

3. The device of claim 1, wherein the vamp fabric bag has a length of about 1 inch to about 7 inches.

4. The device of claim 1, wherein the toe fabric bag has a width of about 1.5 inches to about 6 inches.

5. The device of claim 1, wherein the vamp fabric bag has a front width of about 1.5 inches to about 6 inches and a back width of about 2 inches and 10 inches.

6. The device of claim 1, wherein the toe fabric bag and the vamp fabric bag each contain a compressible form-fitting material.

7. The device of claim 6, wherein the compressible form-fitting material is selected from the group consisting of sand, silica, foam beads, shredded foam, polystyrene particles, popped styrene beads, plastic pellets, cedar chips, polyurethane, polyurethane foam, ethylene vinyl acetate (EVA), thermo moldable foam, cotton, memory foam, rubber, a fabric sack filled with beads, PVC foam (polyvinyl chloride), EPE foam (polyethylene), latex foam, silicon gel, an antimicrobial material, polyolefin, and a combination thereof.

8. The device of claim 1, wherein the toe fabric bag and the vamp fabric bag are each formed of a fabric.

9. The device of claim 8, wherein the fabric is selected from the group consisting of canvas, fleece, silk, cotton, cashmere, linen, rayon, satin, burlap, and a combination thereof.

10. The device of claim 1, wherein each of the toe fabric bag and the vamp fabric bag comprises one or more seams secured by stitching, gluing, taping, liquid stitching, clipping, pinning, using a hook and loop closure, stapling, or a combination thereof.

11. A method of manufacturing a shoe insert, comprising:
providing a toe fabric bag and a vamp fabric bag,
wherein each of the toe fabric bag and the vamp fabric bag are formed of a fabric and contain a moldable material;
wherein a width of a rear portion of the toe fabric bag is the same as a width of a front portion of the vamp fabric bag.

12. The method of claim 11, wherein the toe fabric bag has a length of about 0.5 inches to about 6 inches.

13. The method of claim 11, wherein the vamp fabric bag has a length of about 1 inch to about 7 inches.

14. The method of claim 11, wherein the toe fabric bag has a width of about 1.5 inches to about 6 inches.

15. The method of claim 11, wherein the vamp fabric bag has a front width of about 1.5 inches to about 6 inches and a back width of about 2 inches and 10 inches.

16. The method of claim 11, wherein the toe fabric bag and the vamp fabric bag each contain a compressible form-fitting material.

17. The method of claim 16, wherein the compressible form-fitting material is selected from the group consisting of sand, silica, foam beads, shredded foam, polystyrene particles, popped styrene beads, plastic pellets, cedar chips, polyurethane, polyurethane foam, ethylene vinyl acetate (EVA), thermo moldable foam, cotton, memory foam, rubber, a fabric sack filled with beads, PVC foam (polyvinyl chloride), EPE foam (polyethylene), latex foam, silicon gel, an antimicrobial material, polyolefin, and a combination thereof.

18. The method of claim 11, wherein the toe fabric bag and the vamp fabric bag are each formed of a fabric.

19. The method of claim 18, wherein the fabric is selected from the group consisting of canvas, fleece, silk, cotton, cashmere, linen, rayon, satin, burlap, and a combination thereof.

20. The method of claim 11, wherein each of the toe fabric bag and the vamp fabric bag comprises one or more seams secured by stitching, gluing, taping, liquid stitching, clipping, pinning, using a hook and loop closure, stapling, or a combination thereof.

21. A method of retaining the shape of a shoe, comprising:
providing a toe fabric bag and a vamp fabric bag;
placing the toe fabric bag into a front portion of a shoe and the vamp fabric bag into a vamp portion of a shoe; and
molding the form of the toe fabric bag and the vamp fabric bag within the shoe;
wherein a width of a rear portion of the toe fabric bag is the same as a width of a front portion fabric bag.

22. The method of claim 21, wherein the toe fabric bag has a length of about 0.5 inches to about 6 inches.

23. The method of claim 21, wherein the vamp fabric bag has a length of about 1 inch to about 7 inches.

24. The method of claim 21, wherein the toe fabric bag has a width of about 1.5 inches to about 6 inches.

25. The method of claim 21, wherein the vamp fabric bag has a front width of about 1.5 inches to about 6 inches and a back width of about 2 inches and 10 inches.

26. The method of claim 21, wherein the toe fabric bag and the vamp fabric bag each contain a compressible form-fitting material.

27. The method of claim 26, wherein the compressible form-fitting material is selected from the group consisting of sand, silica, foam beads, shredded foam, polystyrene particles, popped styrene beads, plastic pellets, cedar chips, polyurethane, polyurethane foam, ethylene vinyl acetate (EVA), thermo moldable foam, cotton, memory foam, rubber, a fabric sack filled with beads, PVC foam (polyvinyl chloride), EPE foam (polyethylene), latex foam, silicon gel, an antimicrobial material, polyolefin, and a combination thereof.

28. The method of claim 21, wherein the toe fabric bag and the vamp fabric bag are each formed of a fabric.

29. The method of claim 28, wherein the fabric is selected from the group consisting of canvas, fleece, silk, cotton, cashmere, linen, rayon, satin, burlap, and a combination thereof.

30. The method of claim 21, wherein each of the toe fabric bag and the vamp fabric bag comprises one or more seams secured by stitching, gluing, taping, liquid stitching, clipping, pinning, using a hook and loop closure, stapling, or a combination thereof.

* * * * *